United States Patent [19]

Gary

[11] Patent Number: 4,962,907

[45] Date of Patent: Oct. 16, 1990

[54] DECORATIVE LIGHT HOLDER

[75] Inventor: Lonnie F. Gary, Lubbock, Tex.

[73] Assignee: Gary Products Group, Inc., Lubbock, Tex.

[21] Appl. No.: 294,266

[22] Filed: Jan. 6, 1989

Related U.S. Application Data

[63] Continuation-in-part of Ser. No. 257,392, Oct. 13, 1988, Pat. No. 4,901,960.

[51] Int. Cl.[5] ..... A47B 96/00

[52] U.S. Cl. ..... 248/205.3; 248/316.1; 362/249

[58] Field of Search ..... 248/205.3, 205.4, 314, 248/231–238, 316.7, 903; 362/249, 457

[56] References Cited

U.S. PATENT DOCUMENTS

| | | | |
|---|---|---|---|
| 1,895,656 | 1/1933 | Gadke | 248/231.8 X |
| 2,889,451 | 6/1959 | Longo | 248/314 X |
| 3,189,310 | 6/1965 | Trueson | 248/314 |
| 3,436,102 | 4/1969 | Shelly | 248/903 X |
| 3,504,169 | 3/1970 | Freeburger | 362/249 |
| 3,692,993 | 9/1972 | Robinson | 362/249 X |
| 3,713,614 | 1/1973 | Taylor | 248/205.3 X |
| 3,856,249 | 12/1974 | Frye | 248/205.3 |
| 4,667,276 | 5/1987 | Cheng | 362/249 |
| 4,756,498 | 7/1988 | Frye | 248/205.3 |
| 4,779,177 | 10/1988 | Ahroni | 362/249 X |

*Primary Examiner*—Ramon O. Ramirez

*Attorney, Agent, or Firm*—Ross, Howison, Clapp & Korn

[57] ABSTRACT

Decorative light holders for decorative light and bulb assemblies, comprising a socket support member projecting substantially perpendicularly from the base member to frictionally engage the socket of a decorative light, and an adhesive pad adapted to secure the rearwardly facing surface of the base member to a substantially planar underlying support surface.

2 Claims, 4 Drawing Sheets

DECORATIVE LIGHT HOLDER

CROSS-REFERENCE TO RELATED APPLICATION

This patent application is a continuation-in-part of U.S. application Ser. No. 07/257,392 filed Oct. 13, 1988, issued Feb. 20, 1990 as U.S. Pat. No. 4,901,960.

TECHNICAL FIELD

This invention relates to decorative lighting, and more particularly, to apparatus for supporting and maintaining decorative lights on a substantially planar surface. One aspect of the invention relates to a decorative light holder having an adhesive backing. Another aspect of the invention relates to a decorative light holder structurally adapted to selectively support a decorative bulb and socket assembly in an alignment either parallel or perpendicular to an underlying support surface.

BACKGROUND OF THE INVENTION

The use of ornamental lighting for holiday decorating is well known. Ornamental lighting, especially with "mini-lights", is also useful in marketing displays and for creating special effects in commercial establishments. Strings of decorative lights comprising, for example, twenty-five, fifty, or one hundred individual sockets are typically wired together in either series or parallel circuits with strands of insulated, small-diameter wire to which a plug or plugs are attached at one or both ends to facilitate connection with an electrical energy source or another strand of lights. Clear or colored bulbs are inserted into the sockets to provide the desired lighting effect.

The sockets utilized with such light strings sometimes employ a metal or plastic clip for use in attaching the individual sockets to an elongated support member such as a Christmas tree limb, or the like. Problems have been encountered, however, where the desired decorative lighting scheme requires the attachment of decorative light strings to a substantially planar support surface. Those of ordinary skill in the art have previously sought to overcome this problem by adapting decorative light holders to be maintained on a substantially planar underlying support surface by screw-type fasteners, nails, or the like. One such light holder is disclosed in U.S. Pat. No. 3,189,310. The holder disclosed in U.S. Pat. No. 3,189,310 comprises a base portion and a substantially cylindrical wall having two oppositely disposed horizontal slots. A hole through the base is adapted to receive a screw for securing the holder to a window molding or the facia or eaves of a house. The slots are designed to accommodate the wires extending in either direction from the base of a light socket, and the inside surface of the cylindrical wall is said to taper inwardly at its open end to grip a decorative light socket.

Several disadvantages are experienced through use of a decorative light holder as disclosed in U.S. Pat. No. 3,189,310. First, the necessity for using a screw fastener to attach the decorative holder to an underlying support surface is both difficult and time consuming, and leaves a hole in the support surface once the screw is removed. Second, screws are undesirable for use in attaching decorative lights to support surfaces made of glass. Third, the cylindrical wall sections disclosed in U.S. Pat. No. 3,189,310 require a substantially thick wall in order to provide the required support and maintain their dimensional stability during prolonged use. Fourth, a decorative light holder having an inside wall tapered as required by U.S. Pat. No. 3,189,310 permits excessive wobble when utilized with conventional, commercially available light sockets as depicted in FIG. 4 herein. Fifth, the decorative light holder as disclosed in U.S. Pat. No. 3,189,310 is only useful for supporting a decorative light bulb in a direction perpendicular to the underlying support surface.

A decorative light holder is therefore needed that is adapted to support and maintain an individual socket of a decorative light string on a substantially planar support surface without permanently damaging or defacing the support surface. A decorative light holder is needed that can be quickly and conveniently applied to a glass or plastic support surface and thereafter removed for subsequent reuse. A decorative light holder is needed that can provide adequate lateral support for a decorative bulb socket after prolonged use, without the need for substantially thick sidewalls. A decorative light holder is also needed that is adapted to support a decorative light bulb and socket assembly in a direction either parallel or perpendicular to the underlying support surface as desired by the user. Such a decorative light holder is provided herein.

SUMMARY OF THE INVENTION

According to the present invention, decorative light holders are provided that can be quickly and easily attached to substantially planar underlying support surfaces without the need for screws, nails, staples, or other fasteners that must be inserted into or embedded within the underlying support surface. The subject fasteners can be attached to surfaces such as wood, masonry, glass or plastic, and thereafter removed as desired without permanently injuring or defacing the underlying surface.

According to a preferred embodiment of the invention, a decorative light holder is provided that comprises a base member, means projecting substantially perpendicularly from said base member to frictionally engage the socket of a decorative light, and an adhesive pad adapted to secure the rearwardly facing surface of the base member to a substantially planar underlying support surface.

According to another embodiment of the invention, a decorative light holder is provided in which at least a portion of the means projecting substantially perpendicularly from the base member further defines a plurality of wall sections adapted to frictionally engage the outside wall of a decorative light socket.

According to another embodiment of the invention, a decorative light holder is provided that comprises at least one brace member substantially perpendicular to the base member of the decorative light holder and also substantially perpendicular to the outside surface of the divided socket support member, which projects perpendicularly from the base member.

According to another embodiment of the invention, a decorative light holder is provided in which the inwardly facing surfaces of the socket support member are substantially flat.

According to another embodiment of the invention, a decorative light holder is provided that comprises two perpendicularly disposed base members for use in selectively mounting the subject light holder in a position where the decorative light bulb will be supported in a position either parallel or perpendicular to the underlying support surface as desired.

According to another embodiment of the invention, a decorative light holder is provided in which the inwardly facing surfaces of the socket support member comprise a detent adapted to permit a decorative bulb and socket assembly to be selectively rotated therein to a position either perpendicular or parallel to the underlying support surface.

According to another embodiment of the invention, a decorative light holder is provided in which the socket support members are adapted by means of ribs to provide additional lateral support to a decorative light bulb and socket assembly disposed therein.

According to another preferred embodiment of the invention, a decorative light holder is provided in which one major surface of the adhesive member is adhesively secured to the rearwardly facing surface of the base member, and in which the other major surface of the adhesive member is covered by a relatively thinner sheet material adapted to be peeled off prior to installing the decorative light holder on a substantially planar support surface.

BRIEF DESCRIPTION OF DRAWINGS

The apparatus of the invention is further described and explained in relation to the following drawings in which.

Like numerals are used to indicate like parts in all figures of the drawings.

DESCRIPTION OF THE PREFERRED EMBODIMENTS

Figure 1:
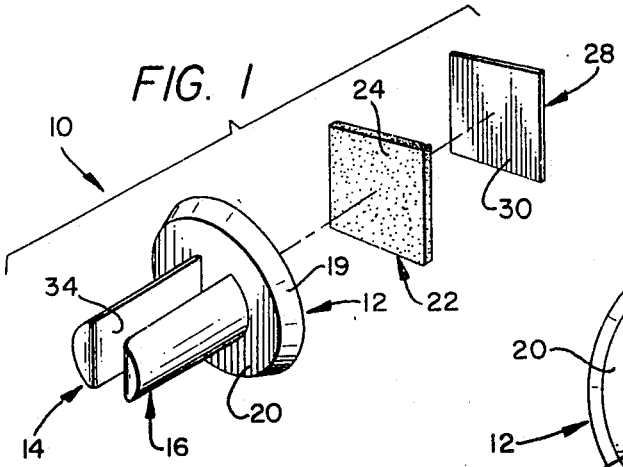
FIG. 1 is an exploded perspective view depicting the decorative light holder of the invention in combination with a sheet material adapted to cover the rearwardly facing surface of the adhesive member until the time of use.
Figure 2:
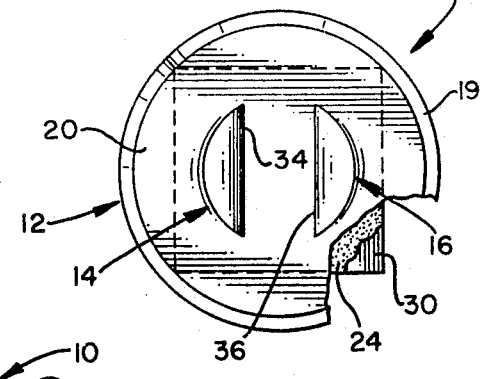
FIG. 2 is a front elevation view of the combination of FIG. 1 in which the base member of the decorative light holder is partially broken away to reveal the adhesive member, and the adhesive member is partially broken away to reveal the covering sheet material as shown in FIG. 1.
Figure 3:
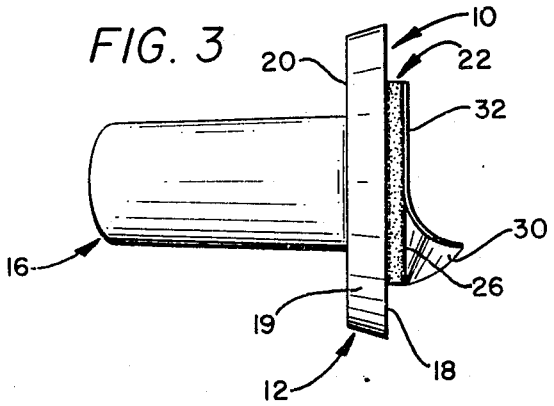
FIG. 3 is a side elevation view depicting the combination of FIG. 1 in assembled rather than exploded form, with one corner of the covering sheet material peeled back from the rearwardly facing major surface of the adhesive member.

Referring to FIGS. 1 through 4, decorative light holder 10 preferably comprises base member 12, opposed socket support members 14, 16, adhesive member 22 and overlying sheet material 28. Base member 12 and divided socket support members 14, 16 are desirably injection molded from any suitable moldable polymeric material. A preferred material for use in making the decorative light holders of the invention comprises a major portion of a moldable acrylic resin.

Decorative light holder 10 is preferably made by injection molding, and adhesive member 22 is thereafter applied to rearwardly facing surface 18 of base member 12. Adhesive member 22 is preferably a pad of polymeric foam material either coated or saturated with a conventional contact adhesive capable of releasably adhering to plastic, glass, wood or masonry surfaces. Such "stick-on" pads are commercially available, and pads approximately 0.16 centimeter thick and made of porous foamed or woven material should function satisfactorily within the scope of the invention. Adhesive member 22 can be applied to rearwardly facing surface 18 of base member 12 at the site of manufacture or at the site of use. If adhesive member 22 is applied to base member 12 at the site of manufacture, overlying sheet material 28 having a forward facing surface 30 substantially co-extensive with rearward facing surface 26 of adhesive member 22 desirably remains attached to adhesive member 22 until the time of use. Overlying sheet material 28 preferably comprises a coated paper or a polymeric material adapted to releasably adhere to the surface of adhesive member 20.

According to another embodiment of the invention, a plurality of decorative light holders 10 are made available in packages comprising a plurality of molded plastic devices further comprising a base member 12 and opposed socket support members 14, 16, in combination with a plurality of adhesive members 22 having overlying sheet material 28 disposed on both forwardly facing surfaces 24 and rearwardly facing surface 26 of adhesive member 22. At the use sight, overlying sheet material 28 is first peeled from forwardly facing surface 24 which is then pressed into contact with rearwardly facing surface 18 of base member 12.

Figure 4:
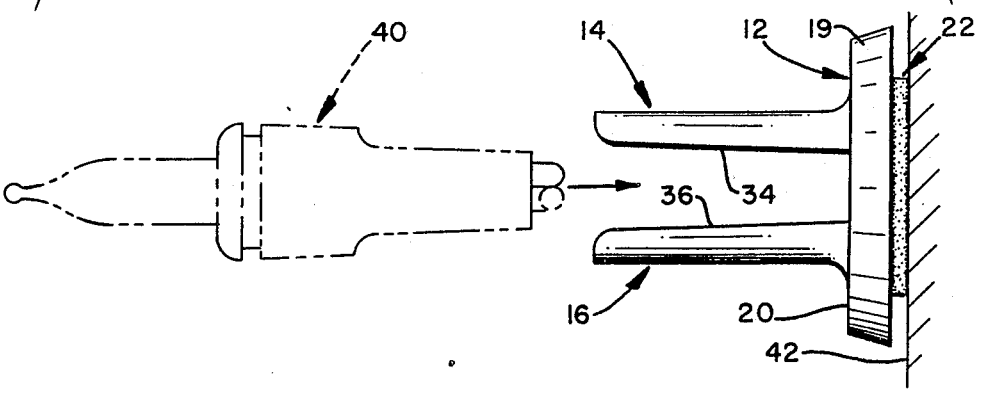
FIG. 4 is a plan view depicting the decorative light holder of FIGS. 1, 2 and 3 with the covering sheet material removed and installed on a substantially planar underlying surface, with one bulb/socket/conductor : unit of a decorative light string shown in phantom in the position in which the socket would be inserted into the decorative light holder.

To apply decorative light holder 10 to a support surface 42 as shown in FIG. 4, overlying sheet material 28 is peeled away from rearwardly facing surface 26 of adhesive member 22, and base member 12 is then pressed against substantially planar support surface 42 so that adhesive member 22 establishes a bond therebetween. Adhesive member 22 is desirably selected so that the bond established between base member 12 and planar support member 42 can be broken whenever base member 12 is grasped and pulled away from support surface 42 by manual force.

As shown in FIGS. 1 through 4, socket support members 14, 16 comprise substantially planar surfaces 34, 36, respectively, which are spaced apart on forwardly facing surface 20 of base member 12 so as to provide frictional engagement with the socket portion of bulb-/socket/conductor unit 40 when inserted therebetween. As shown in FIG. 4, surfaces 34, 36 of socket support members 14, 16 are substantially perpendicular to forwardly facing surface 20 of base member 12, but taper slightly inwardly near base member 12 (opposite to the direction of taper disclosed in U.S. Pat. No. 3,189,310).

According to a particularly preferred embodiment of the invention, socket support members 14, 16 are sized so as to frictionally engage sockets adapted for use with conventionally sized 3.5 volt CH659 bulbs.

Although base member 12 is shown as being round and adhesive member 22 is shown as being square in FIGS. 1 through 4, it will be apparent that other geometries can also be used effectively within the scope of the invention provided that base member 12 has a substantially planar rearwardly facing surface 18 and that adhesive member 22 has substantially planar forwardly and rearwardly facing surfaces 24, 26 that do not extend outwardly beyond edge 19 of base member 12.

Figure 5:
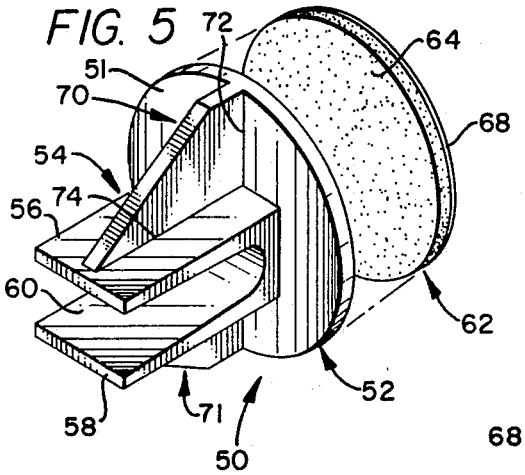
FIG. 5 is an exploded perspective view of another embodiment of the subject decorative light holder in which the adhesive member is shown as being spaced apart from the rearwardly extending surface of the base member.
Figure 6:
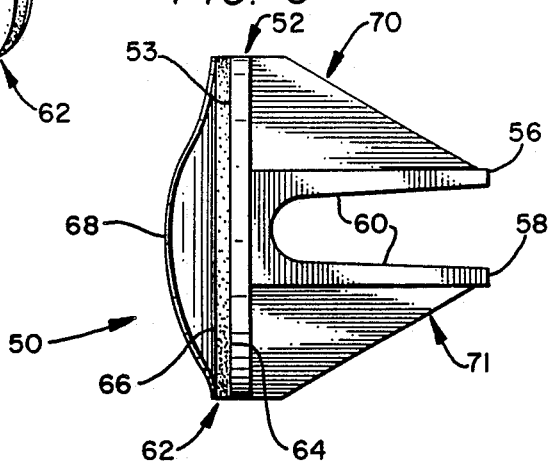
FIG. 6 is a side elevation view of the decorative light holder shown in FIG. 5 wherein the adhesive member is no longer depicted as being exploded away from the rearwardly facing surface of the base member, but in which the sheet material overlying the rearwardly facing major surface of the adhesive member has been partially peeled back away from the adhesive member.

Referring to FIGS. 5 and 6, another preferred embodiment of the invention, decorative light holder 50 is shown which comprises base member 52, socket support member 54, comprising socket support arms 56, 58, brace members 70, 71 and adhesive member 62. In this embodiment of the invention, adhesive member 62 is substantially co-extensive with rearwardly facing surface 53 of base member 52. Overlying sheet material 68 is shown in FIG. 5 in co-extensive and contacting relation with rearwardly facing surface 66 of adhesive member 62. In FIG. 6, overlying sheet material 68 is shown as being partially peeled away from rearwardly facing surface 66 of adhesive member 62.

In FIG. 5, adhesive member 62 is depicted in exploded fashion so as to better illustrate the appearance of forwardly facing surface 64 although it is understood that in application, forwardly facing surface 64 of adhesive member 62 is in substantially coextensive and contacting relation with rearwardly facing surface 53 of base member 52 as shown in FIG. 56.

Brace members 70, 71 are preferably unitarily molded with socket support member 54 and base member 52 so as to provide structural support to socket support arms 56, 58. Inwardly facing surface 60 of socket support member 54 is a generally U-shaped surface that tapers inwardly near forwardly facing surface 51 of base member 52 in order to provide better frictional engagement with the similarly tapered surfaces of a conventional "mini-light" socket as depicted in bulb/socket/conductor unit 40 in FIG. 4. A major portion of brace member 70 preferably lies in a plane substantially perpendicular to the plane of forwardly facing surface 51 of base member 52, and also substantially perpendicular to the outwardly facing surface of socket support arm 56, which is in turn substantially perpendicular to surface 51. Intersection line 72 between brace member 70 and forwardly facing surface 51 of base member 52 is preferably substantially perpendicular to socket support arm 56; line of intersection 74 between brace member 70 and socket support arm 56 is desirably perpendicular to surface 51 and lines of intersection 72, 74 are desirably perpendicular to each other. As shown in FIGS. 5 and 6, inwardly facing surface 60 of socket support arms 56, 58 of socket support member 54 is substantially flat, except for the curved portion near base member 52.

Figure 7:
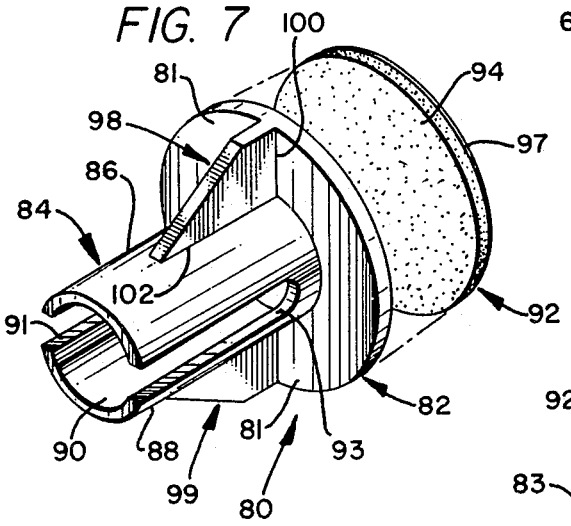
FIG. 7 is an exploded perspective view of another embodiment of the invention in which the adhesive member and its overlying sheet material are shown as being exploded away from the rearwardly facing surface of the base member.
Figure 8:
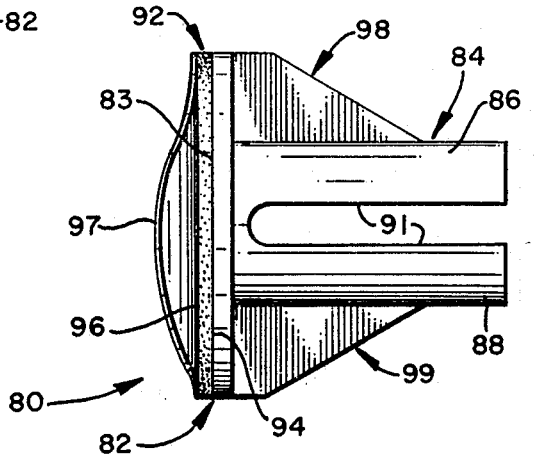
FIG. 8 is a side elevation view depicting the apparatus of FIG. 7 wherein the adhesive member is no longer exploded away from the rearwardly facing surface of the base member, but in which a portion of the overlying sheet material has been peeled back from the rearwardly facing surface of the adhesive member.

Referring to FIGS. 7 and 8, a particularly preferred embodiment of the subject apparatus is shown wherein decorative light holder 80 preferably comprises base member 82, socket support member 84, adhesive member 92 and brace members 98, 99. Base member 82 preferably comprises forwardly facing surface 81 and rearwardly facing surface 83. Socket support member 84 preferably comprises a plurality of spaced apart socket support arms 86, 88 having arcuate inwardly facing surfaces substantially perpendicular to forwardly facing surface 81 of base member 82 as illustrated by surface 90 of socket support arm 88. Edges 91, 93 of socket support arms 86, 88 preferably define a substantially rectangular slot adapted to accommodate the wires of a conventional "mini-light" electrical socket inserted into frictional engagement with the inwardly facing surfaces of socket support member 84. Adhesive member 92 is depicted in FIG. 7 as being exploded away from base member 82, but in actual use is understood to be in contacting relation with rearwardly facing surface 83 of base member 82 as shown in FIG. 8. Overlying material 97 shown in coextensive and substantially contacting relation with rearwardly facing surface 96 of adhesive member 92 in FIG. 7 but is shown being peeled away from surface 96 in FIG. 8.

Brace member 98 is shown as being substantially perpendicular to both the plane of forwardly facing surface 81 of base member 82 and the outwardly facing surface of socket support arm 86 of socket support member 84, as demonstrated by lines of intersection 100, 102, respectively, which are also preferably substantially perpendicular to each other.

Brace members 70, 71 and 98, 99 as shown in FIGS. 5–8 are particularly useful for maintaining the dimensional stability of socket support members 54, 84 even after decorative light holders 50, 80 are subjected to heating, or stretching through prolonged or repeated use. Adhesive members 62, 82 are desirably adapted to be removed from base members 52, 82 following use so that new adhesive members can be applied to such base members at a later date for further use. Adhesive members 62, 92, respectively, can be disposed of once removed from base members 52, 82.

Figure 9:
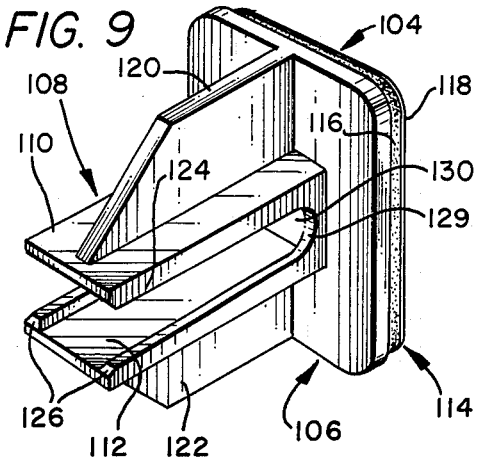
FIG. 9 is a perspective view of another embodiment of the subject decorative light holder in which the socket support members comprise ribs adapted to provide additional lateral support to a decorative light bulb and socket assembly (not shown) disposed therein.
Figure 10:
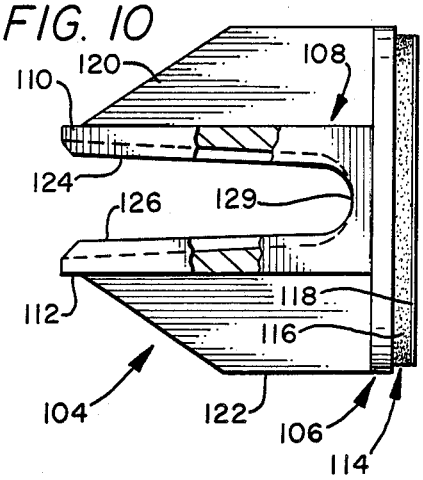
FIG. 10 is a side elevation view, partially in section, of the decorative light holder depicted in FIG. 9.
Figure 11:
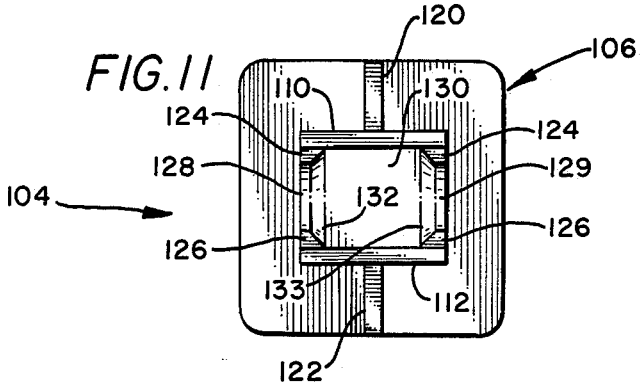
FIG. 11 is a front elevation view of the decorative light holder depicted in FIG. 9.

Referring to FIG. 9, 10 and 11, another preferred embodiment of the invention, decorative light holder 104 comprises base member 106 having adhesive member 114 attached to the rearwardly facing surface thereof; socket support member 108 extending substantially perpendicularly outward from the forward facing surface of base member 106; and brace members 120, 122 extending substantially perpendicularly outward from both base member 106 and socket support member 108. Base member 114 preferably further comprises adhesive layer 116 and an overlying sheet of cover material 118 which is removed prior to installation of decorative light holder 104.

Socket support means 108 preferably comprises socket support arms 110, 112, which further comprise support ribs 124 and lower support ribs 126. Support ribs 124, 126 cooperate with the inwardly facing surfaces of socket support arms 110, 112 to maintain the socket of a "mini-light" in substantially perpendicular alignment to base member 106. In the preferred embodiment shown in FIGS. 9, 10 and 11, support ribs 124, 126 extend rearwardly from the open end of socket support member 108, converging arcuately in radii 128, 129 near base member 106. Referring to FIG. 11, radii 132, 133 are formed where upper and lower support arms 110, 112 intersect forward facing wall section 130 of base member 106. In this embodiment of the invention, as with the embodiment described in relation to FIGS. 5 and 6 above, the inwardly facing major surfaces of socket support arms 110, 112 preferably taper slightly toward each other in the direction of base member 106 to assist in providing frictional engagement with a socket inserted therebetween. It is understood of course that the spacing between support ribs 124, 126 and support arms 110, 112 can vary within the scope of the invention, depending upon the dimensions of the decorative bulb and socket assemblies intended for use therewith.

Figure 12:
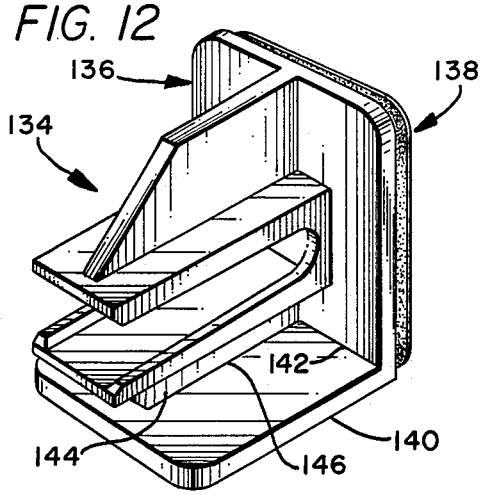
FIG. 12 is a perspective view of another embodiment of the subject decorative light holder wherein perpendicularly disposed base members are provided to enable the user to selectively mount the light holder so as to support the decorative bulb and socket assembly in either parallel or perpendicular relation to the underlying support surface.
Figure 13:
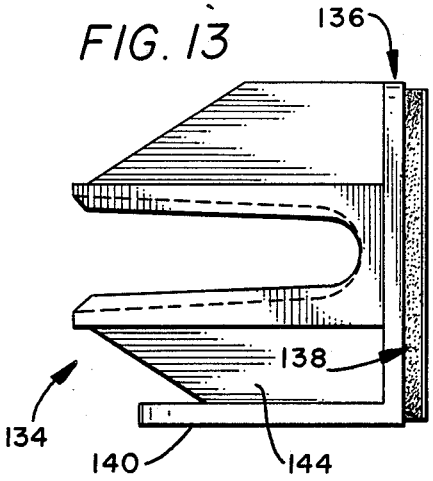
FIG. 13 is a side elevation view off the decorative light holder depicted in FIG. 12.
Figure 14:
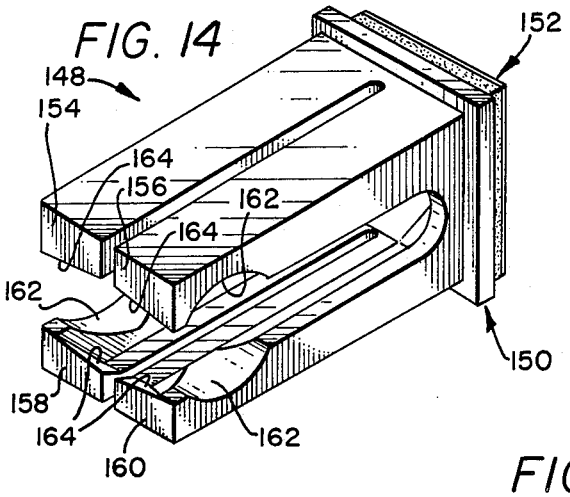
FIG. 14 is a perspective view of another embodiment of the subject decorative light holder wherein the socket support members comprise an arcuate detent adapted to permit a decorative bulb and socket assembly to be selectively rotated therein to a position either parallel or perpendicular to the underlying support surface.
Figure 15:
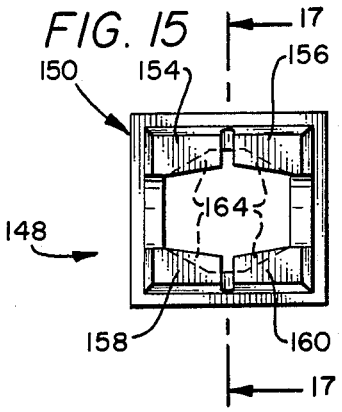
FIG. 15 is a front elevation view of the decorative light holder depicted in FIG. 14.

According to another embodiment of the invention, shown in FIGS. 12 and 13, decorative light holder 134 comprises a first base member 136 having adhesive member 138 adhered to its rear surface as described above in relation to base member 106 of FIGS. 9 and 10, and a second base member 140 disposed perpendicularly to base member 136 and joined thereto along intersection line 142. Second base member 140 is also preferably joined to brace member 144 at line 146 as shown in FIG. 12. When constructed in this manner, decorative light holder 134 can be utilized to support a decorative bulb and socket assembly either parallel or perpendicular to the underlying support surface.

Thus, for example, where decorative light holder 134 is used on the inside of a window and it is desired that the bulb be visible from the outside, base member 140 can be attached to the underlying support surface so that the decorative bulb and socket assembly (now shown) will be substantially parallel to the window when the socket is inserted between the socket support arms. When the user desires to mount decorative light holder 134 in this manner, adhesive member 138 will desirably be attached to base member 140 rather than base member 136 as shown.

According to one embodiment of the invention, decorative light holder 134 is provided with an unattached adhesive pad having a removable protective cover on each side thereof. At the time of use, the user can remove the protective cover from one side of the adhesive means and apply the adhesive means to whichever base member is preferred for mounting the decorative light holder in the desired position relative to the underlying support surface. The remaining protective cover is then removed at the time of applying the decorative light holder to the underlying support surface.

Figure 16:
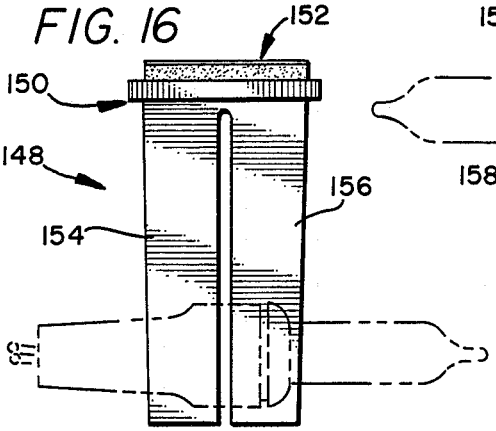
FIG. 16 is a plan view of the decorative light holder depicted in FIG. 14.
Figure 17:
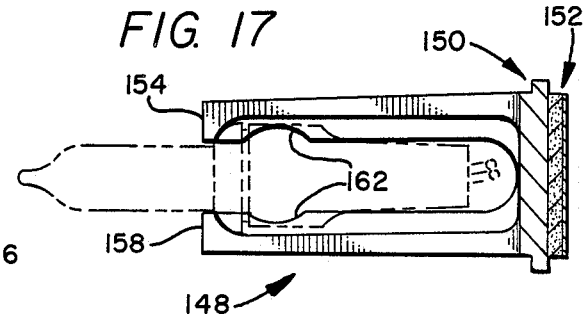
FIG. 17 is a sectional side elevation view of the decorative light holder depicted in FIG. 14, taken along line 17—17 of FIG. 15.

Another embodiment of the subject invention is described in relation to FIGS. 14, 15, 16 and 17. According to this embodiment of the invention, socket support member 148 further comprising socket support arms 154, 156, 158 and 160 extends substantially perpendicularly outward from base member 150 to which adhesive member 152 is attached. Each of socket support arms 154, 156, 158 and 160 preferably further comprises recesses 162 and lips 164 adapted to permit the socket portion of a decorative bulb and socket assembly to be rotated between a position substantially perpendicular to base member 150 as shown in FIG. 17 (and the underlying support surface after installation) to a position substantially parallel to base member 150 as shown in FIG. 16. Socket support member 148 and base member 150 are preferably molded as a single unit for a polymeric resin. The spacing between socket support arms 154, 156, 158 and 160, lips 164, and the depth of recesses 162 and is preferably such that a socket can be inserted into support member 148 and thereafter frictionally engaged by the abutting interior surfaces of support member 148.

Figure 19:
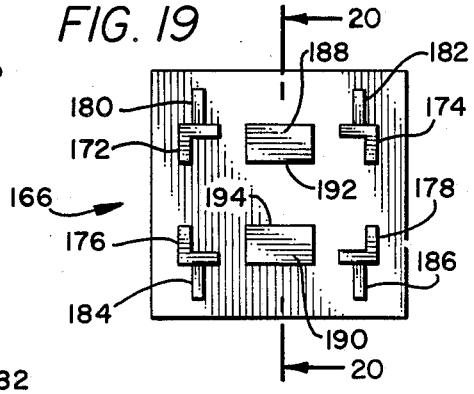
FIG. 19 is a front elevation view of the decorative light holder depicted in FIG. 18.
Figure 18:
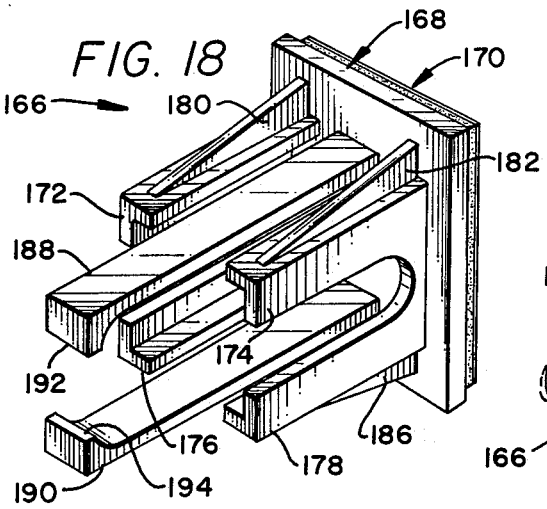
FIG. 18 is a perspective view of another embodiment of the subject decorative light holder wherein a plurality of socket support members are provided that are adapted to frictionally engage slots in a socket used with mini-lights.
Figure 20:
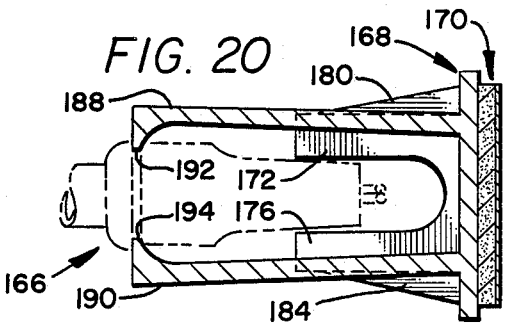
FIG. 20 is a sectional side elevation view of the decorative light holder depicted in FIG. 18, taken along line 20—20 of FIG. 19.

Another embodiment of the invention, decorative light holder 166, is described in relation to FIGS. 18, 19 and 20. This embodiment preferably comprises support arms 172, 174, 176 and 178, and gripping arms 188, 190 extending substantially perpendicularly outward from base member 168. Gripping arms, 188, 190 further comprise lips 192, 194, respectively. When used with a conventional "mini-light" socket, support arms 172, 174, 176 and 178 engage the bottom portion of the socket and lips 192, 194 of gripping arms 188, 190 engage a slot in the side of the outwardly extending portion of the socket as shown in FIG. 20. With decorative light holder 166, the decorative bulb and socket assembly receives lateral support from the support arms and gripping arms, and is simultaneously restrained from slipping out of the holder by lips 192, 194.

While the invention is described herein in relation to exemplary preferred embodiments, it is also seen from the figures of the drawings that the geometry of the socket support members and socket support arms can vary within the scope of the invention so long as adequate frictional contact is established between the inwardly facing surface or surfaces of the socket support member and the outwardly facing surface of a conventional decorative light socket, while also providing space for the wires connected to the socket whenever the socket is inserted into the decorative light holder.

Other alterations and modifications of the subject invention will become apparent to those of ordinary skill in the art upon reading this disclosure, and it is intended that the scope of Applicant's invention be limited only by the broadest interpretation of the appended claims to which the Applicant is legally entitled.

It is also seen from the figures of the drawings that the geometry of the socket support members and socket support arms can vary within the scope of the invention so long as adequate frictional contact is established between the inwardly facing surface or surfaces of the socket support member and the outwardly facing surface of a conventional decorative light socket, while also providing space for the wires connected to the socket whenever the socket is inserted into the decorative light holder.

Other alterations and modifications of the subject invention will become apparent to those of ordinary skill in the art upon reading this disclosure, and it is intended that the scope of Applicant's invention be limited only by the broadest interpretation of the appended claims to which the Inventor may be legally entitled.

What is claimed is:

1. A decorative light holder adapted to receive a decorative light socket and support a decorative light bulb and socket assembly by frictional contact between said holder and said socket, said holder comprising a base member having forwardly and rearwardly facing surfaces; a socket support member comprising a plurality of opposed support arms extending outwardly from the forwardly facing surface of said base member; a brace member connected to each of said support arms and to said base member; and an adhesive means affixed to the rearwardly facing surface of said base member; said opposed support arms further comprising opposed interiorly facing surfaces inwardly tapered in the direction of said base member, said surfaces of said support arms being adapted to provide frictional engagement with a decorative light socket inserted therebetween; said support arms further comprising a plurality of spaced apart ribs extending substantially perpendicularly from said facing surfaces of said support arms, said ribs being adapted to cooperate with said facing surfaces of said support arms to provide lateral support to said socket when inserted into said support member.

2. A decorative light holder adapted to receive a decorative light socket and support a decorative light bulb and socket assembly by frictional contact between said holder and said socket and to secure said holder to a substantially planar underlying surface, said holder comprising first and second base members disposed in substantially perpendicular relation to each other, said first base member having forwardly and rearwardly facing surfaces, and said second base member having upwardly and downwardly facing surfaces; a socket support member comprising a plurality of opposed support arms extending outwardly from the forwardly facing surface of said first base member; a brace member connected to each of said support arms and to at least one of said base members; and an adhesive means adapted to be selectively to the rearwardly facing surface of said first base member to the downwardly facing surface of said second base member; said opposed support arms further comprising opposed interiorly facing surfaces inwardly tapered in the direction of said base member, said surfaces of said support arms being adapted to provide a frictional engagement with a decorative light socket inserted therebetween; said first base member being adapted to cooperate with said adhesive means in securing said holder to an underlying support surface substantially perpendicular to said bulb and socket assembly when said socket is inserted into said support member, and said second base member being adapted to cooperate with said adhesive means in securing said holder to an underlying support surface substantially parallel to said bulb and socket assembly when said socket is inserted into said support member.

* * * * *